US006922855B1

(12) United States Patent
Swalley et al.

(10) Patent No.: US 6,922,855 B1
(45) Date of Patent: Aug. 2, 2005

(54) SELF-STORING POOL CLEANING APPARATUS AND ASSOCIATED METHODS

(76) Inventors: Robert D. Swalley, 149 Fig Tree Run, Longwood, FL (US) 32750; Eugene W. Barco, P.O. Box 2721, Sanford, FL (US) 32772

( * ) Notice: Subject to any disclaimer, the term of this patent is extended or adjusted under 35 U.S.C. 154(b) by 0 days.

(21) Appl. No.: 10/368,793

(22) Filed: Feb. 19, 2003

Related U.S. Application Data

(60) Provisional application No. 60/358,031, filed on Feb. 20, 2002.

(51) Int. Cl.[7] ..... E04H 4/16
(52) U.S. Cl. ..... 4/490; 134/168 R
(58) Field of Search ..... 4/490; 15/1.7; 210/169, 416.2; 134/167 R, 168 R

(56) References Cited

U.S. PATENT DOCUMENTS 3,278,949 A * 10/1966 Whitaker ..... 4/490 X
3,530,511 A * 9/1970 Berg et al. ..... 4/490
3,575,729 A * 4/1971 Howard ..... 134/168 R
3,665,525 A * 5/1972 Howard ..... 134/168 R X
4,100,641 A * 7/1978 Pansini ..... 15/1.7
4,683,599 A * 8/1987 Rief ..... 4/490
4,907,610 A * 3/1990 Meincke ..... 4/490 X

* cited by examiner

*Primary Examiner*—Robert M. Fetsuga
(74) *Attorney, Agent, or Firm*—Allen, Dyer, Doppelt, Milbrath & Gilchrist, P.A.

(57) ABSTRACT

A self-storing apparatus and method for cleaning a swimming pool include a water pump; a self-propelled pool vacuum cleaner; a flexible hose fluidly connecting the water pump with the pool vacuum cleaner; a housing positioned along a submerged surface of the swimming pool and having sufficient capacity for therein receiving and storing the pool vacuum cleaner; a storage conduit in fluid communication with the housing and the water pump for therein receiving and storing the flexible hose upon retraction, the fluid communication being selectable between pressure and suction; a piston connected to the flexible hose and movably positioned within the conduit responsive to the water pump to thereby deploy and retract the hose and pool vacuum cleaner; and a retaining member positioned to engage the piston for retaining the hose deployed from the storage conduit responsive to water circulation generated by the water pump.

28 Claims, 5 Drawing Sheets

SELF-STORING POOL CLEANING APPARATUS AND ASSOCIATED METHODS

RELATED APPLICATION

This application claims priority from provisional application Ser. No. 60/358,031, which was filed on Feb. 20, 2002, and which is incorporated herein by reference in its entirety.

FIELD OF THE INVENTION

The present invention relates to the field of swimming pools and, more particularly, to an automatic self-storing pool cleaning apparatus, a pool constructed to include the apparatus, and to its associated methods.

BACKGROUND OF THE INVENTION

Typical swimming pool installations include a system which provides a water pump and a filter generally located adjacent the pool for recirculating and cleaning the water of suspended particulates. These systems usually include a skimmer device located along the side wall of the pool enclosure at water level for suctioning off floating debris and surface film. The skimmer includes a small filter basket for catching larger particulates before these enter the associated conduit network and the main pool filter. The swimming pool will also have a main drain located along the deepest portion of the floor of the pool. The main drain communicates with a conduit leading to the water pump, which generally includes a removable filter basket for intercepting large particulates before they pass through the pump mechanism and on to the main filter.

An additional pool cleaning device also employed is a water suction activated pool vacuum cleaner. These devices are usually self-powered by being propelled through the action of the water pump as it suctions water through the pool vacuum cleaner and its attached hose. The pool vacuum cleaner is typically a dandomly roaming device which suctions water very close to the pool's submerged surfaces, both the pool floor and the side walls, as it roams. Many varieties of these devices are known, and are intended to be included within the scope of the present invention.

The problem, however, is that a pool vacuum cleaner is not generally left permanently connected to the water recirculation system, as the cleaner itself and its associated hose will get in the way of swimmers and obstruct other recreational activities in the pool. Because of this, the pool owner will connect the pool vacuum cleaner into the system as needed for cleaning the pool, and will then have to disconnect the cleaner and hose and separately store the combination out of the pool. Most pool owners find this to be a tedious activity, and have difficulty maintaining a proper cleaning schedule. Additionally, storing the pool vacuum cleaner and hose require some type of storage closet or storage box in order to keep the inactive device out of sight and promote safety and orderliness around the pool area.

SUMMARY OF THE INVENTION

With the foregoing in mind, the present invention advantageously provides a pool cleaning apparatus which is self-storing, a self-cleaning swimming pool, and associated methods. The apparatus comprises a water pump in fluid communication with the swimming pool to circulate water therein. A pool vacuum cleaner is connected in fluid communication with the water pump and includes a self-propelled body for cleaning submerged surfaces of the swimming pool, the body preferably being self-propelled responsive to water circulation caused by the water pump. A flexible hose fluidly connects the water pump with the pool vacuum cleaner to circulate water therethrough responsive to the water pump. A housing is positioned along a submerged surface of the swimming pool, the housing having sufficient capacity for therein receiving the pool vacuum cleaner upon retraction responsive to the water pump. The apparatus includes at least one conduit in fluid communication with the housing and with the water pump for therein receiving the flexible hose upon retraction responsive to the water pump, the fluid communication being selectable between a pressure side and a suction side of the water pump. A piston is connected to the flexible hose adjacent a hose end opposite the cleaner and movably positioned within the at least one conduit so as to be responsive to water circulation generated by the water pump to thereby deploy and retract the hose and pool vacuum cleaner. A retaining member is positioned to engage the piston adjacent the housing for retaining the hose deployed from the at least one conduit responsive to water circulation generated by the water pump.

BRIEF DESCRIPTION OF THE DRAWINGS

Some of the features, advantages, and benefits of the present invention having been stated, others will become apparent as the description proceeds when taken in conjunction with the accompanying drawings, presented for solely for exemplary purposes and not with intent to limit the invention thereto, and in which.

DETAILED DESCRIPTION OF THE PREFERRED EMBODIMENT

The present invention will now be described more fully hereinafter with reference to the accompanying drawings, in which preferred embodiments of the invention are shown. Unless otherwise defined, technical and scientific terms used herein have the same meaning as commonly understood by one of ordinary skill in the art to which this invention pertains. Although methods and materials similar or equivalent to those described herein can be used in the practice or testing of the present invention, suitable methods and materials are described below. All publications, patent applications, patents, and other references mentioned herein are incorporated by reference in their entirety. In case of conflict, the present specification, including any definitions, will control. In addition, the materials, methods and examples given are illustrative in nature only and not intended to be limiting. Accordingly, this invention may, however, be embodied in many different forms and should not be construed as limited to the illustrated embodiments set forth herein. Rather, these illustrated embodiments are provided solely for exemplary purposes so that this disclosure will be thorough and complete, and will fully convey the scope of the invention to those skilled in the art. Other features and advantages of the invention will be apparent from the following detailed description, and from the claims.

Figure 1:
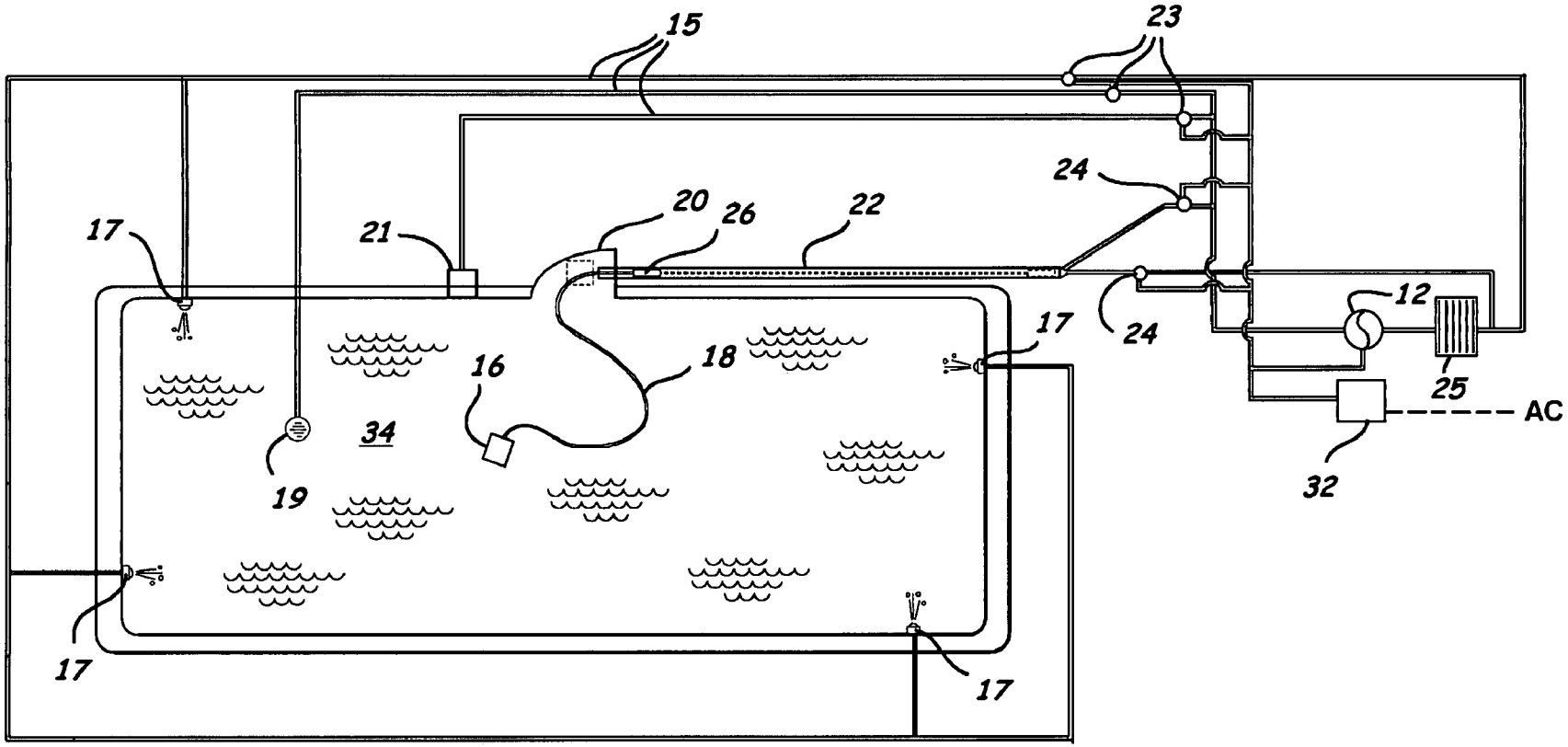
FIG. 1 is a schematic diagram of a self-cleaning swimming pool according to an embodiment of the present invention.
Figure 2:
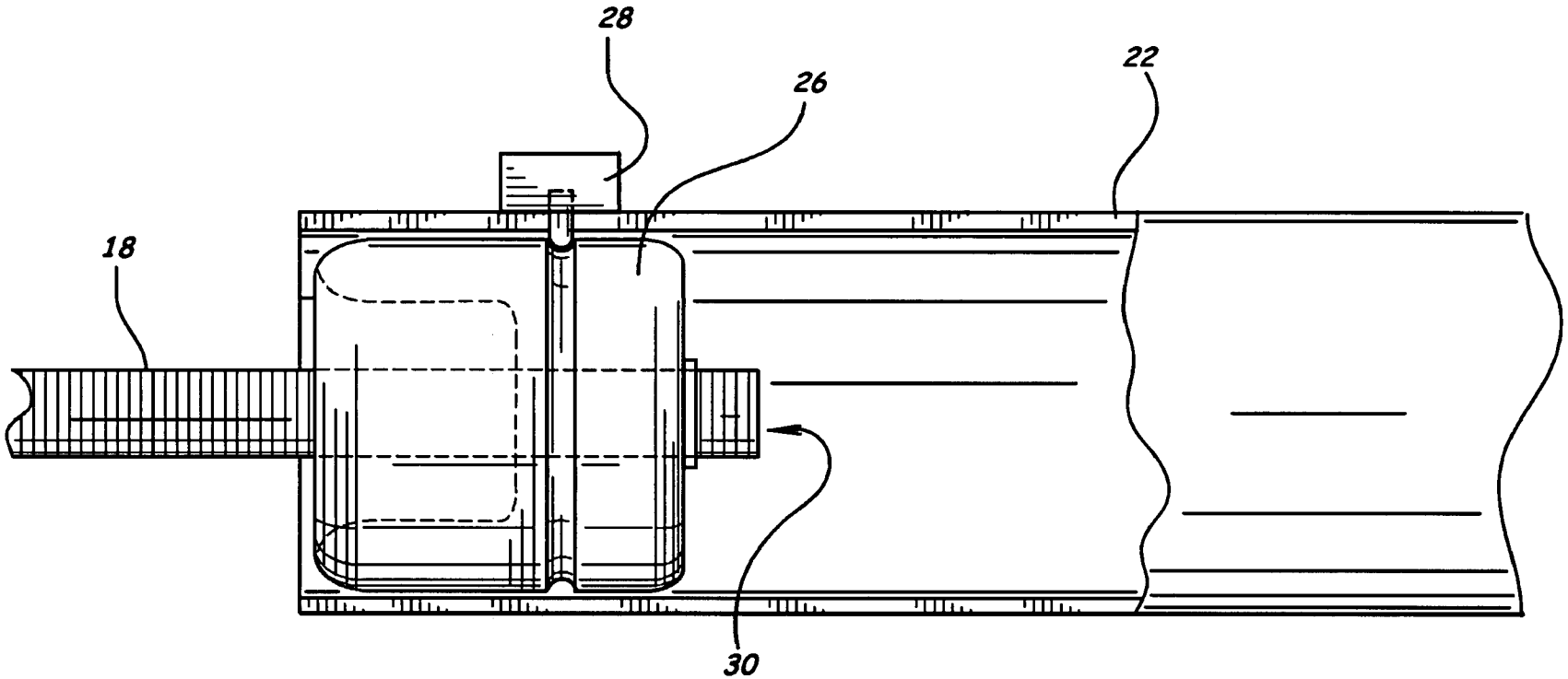
FIG. 2 shows a cross sectional side elevation of a piston positioned as described in a conduit which is fluidly connected to the water pump.
Figure 3:
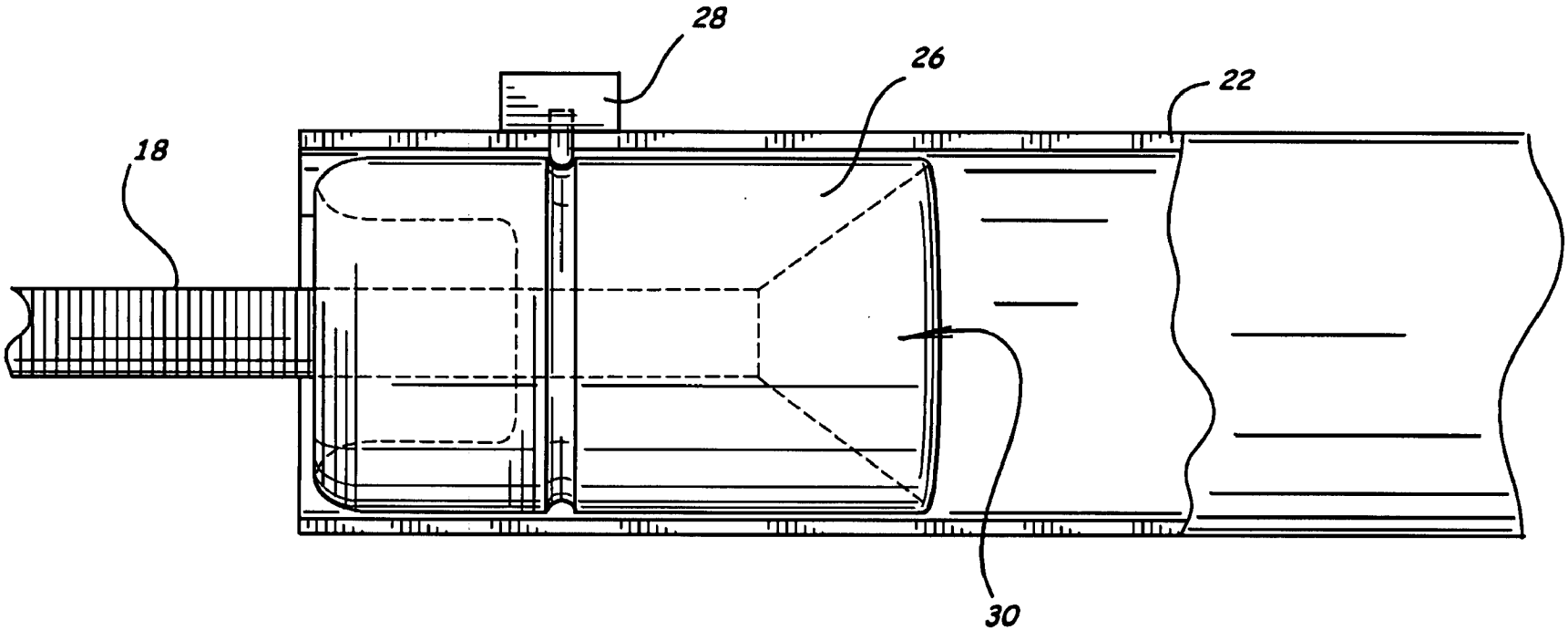
FIG. 3 is a cross sectional side elevatio view of an alternate embodiment of the piston of FIG. 2 having a funnel-shaped outlet end to reduce hydraulic turbulence adjacent the piston.

FIGS. 1–3 illustrate various aspects of the swimming pool cleaning apparatus of the present invention. The apparatus comprises a water pump 12 in fluid communication with the swimming pool 14 to circulate water therein. A pool vacuum cleaner 16 is positioned in the pool 14 in fluid communication with the water pump 12. The pool vacuum cleaner 16 preferably is self-propelled for cleaning submerged surfaces of the swimming pool. The skilled understand that the vacuum cleaner 16 is preferably self-propelled responsive to water circulation caused by the water pump, but that other modes of self-propulsion are included within the scope of the invention. A flexible hose 18 fluidly connects the water pump 12 with the pool vacuum cleaner 16 to circulate water therethrough responsive to the water pump.

A housing 20 is positioned along a submerged surface of the swimming pool, the housing having sufficient capacity for therein receiving the pool vacuum cleaner 16 upon retraction responsive to the water pump 12. A preferable location for positioning of the housing 20 is along an upper portion of a sidewall of the swimming pool 14. At least one conduit 22 is positioned in fluid communication with the housing 20 and with the water pump 12 to serve for therein receiving the flexible hose 18 upon retraction responsive to the water pump. The fluid communication between the conduit 22 and the water pump 12 is selectable between a pressure side and a suction side of the water pump. The skilled will realize that selecting the pressure side of the pump will generate a positive water pressure within the conduit, whereas selecting the suction side of the water pump will create suction through the conduit, or a water vacuum effect. Selection is preferably made by at least one selector valve 24, or by a plurality of selector valves, as shown in FIG. 1.

A piston 26, as shown in FIG. 2, is connected to the flexible hose 18 adjacent a hose end opposite the vacuum 16 cleaner and is movably positioned within the conduit 22 so as to be responsive to water circulation generated by the water pump 12 to thereby deploy and retract the hose and connected pool vacuum cleaner. A retaining member 28 is positioned to engage the piston adjacent the housing for retaining the hose and connected pool vacuum cleaner in deployment from the at least one conduit responsive to water circulation generated by the water pump. Those skilled in the art will understand that the retaining member may comprise a latch which engages a recess positioned along an outer periphery of the piston, as shown by way of non-limiting example in FIGS. 2 and 3, but that other mechanisms for retaining the piston will be apparent and are intended to be within the scope of the invention.

In one preferred embodiment of the invention, the piston 26 includes a funnel-shaped end as shown in FIG. 3. During suction vacuuming operation, the funnel-shaped piston end acts as an outlet for water being suctioned through the pool vacuum cleaner 16 and through the flexible hose 18. The funnel-shaped outlet aids in reducing hydraulic eddies forming at the piston discharge outlet 30. If such eddies occur, small particulates picked up from the pool's submerged surfaces by the vacuum cleaner will tend to accumulate next to the piston and could interfere with the piston's mobility through the conduit for retraction, for example. It is not uncommon for a pool vacuum cleaner to pick up small particulates, especially small granular material which sloughs off the pool's underwater finish as the vacuum cleaner travels over the surface.

Figure 4:
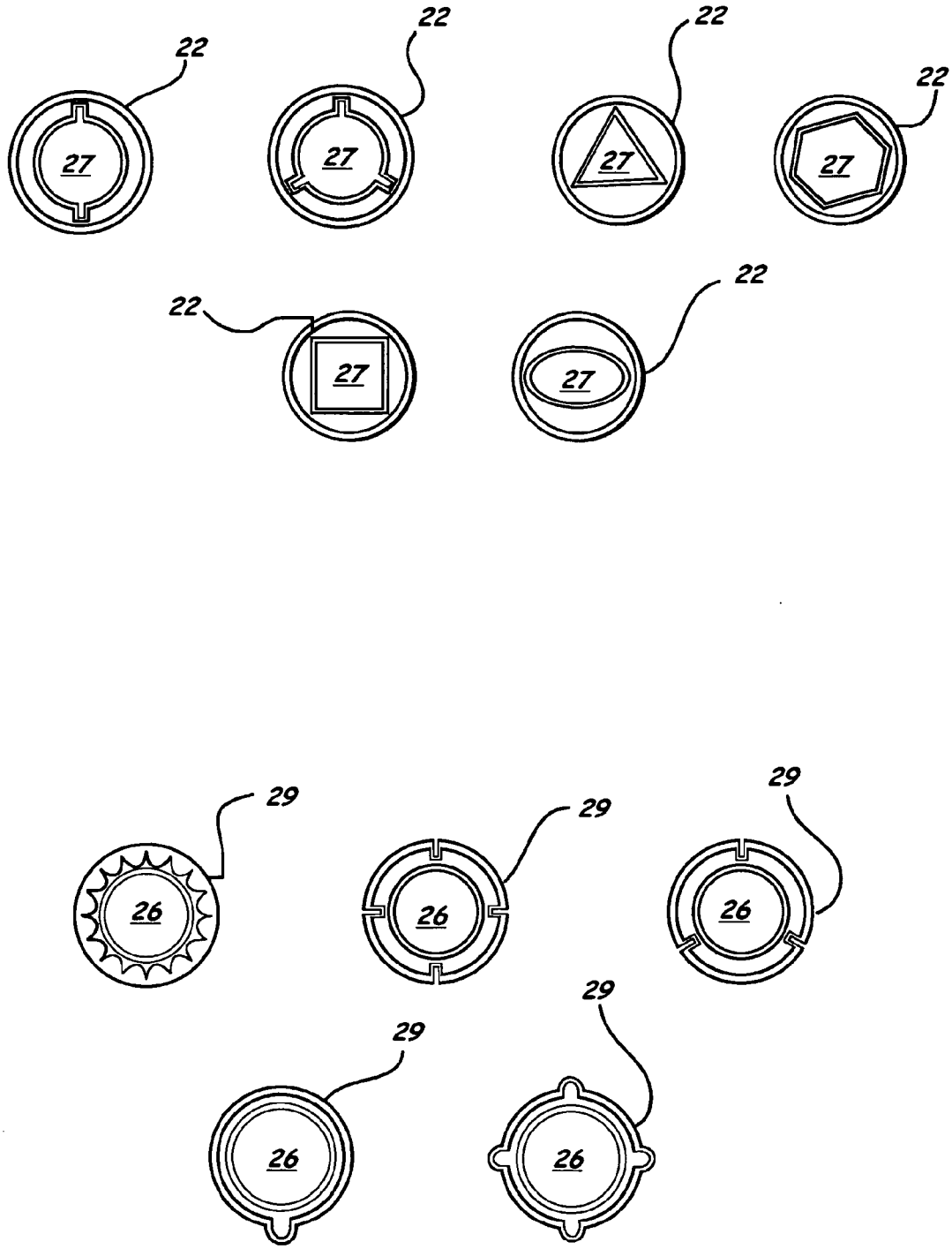
FIG. 4 shows cross sections of alternate embodiments of the apparatus having enhanced clearance between a non-circular piston and the interior sidewalls of the conduit.

In another preferred embodiment of the invention, as generally illustrated in FIG. 4, the piston 27 comprises a non-circular cross section. Those skilled in the art will recognize, as described above, that a pool vacuum cleaner may pick up sand, debris, dirt, and granular material which primarily detaches from the submerged surfaces of the pool. These small particulates may have a tendency to accumulate along the storage conduit and directly behind the piston. A typical piston having a circular cross section which almost completely fills the lumen of the conduit is likely to have difficulty traversing the conduit when such small particulate debris is present along the inner walls of the conduit. Typically, the piston is likely to get stuck due to the increased friction generated by the particulates. In order to overcome this problem, a preferred embodiment of the invention comprises a piston which has a non-circular cross section. Many such non-circular cross sectional piston profiles may be employed in the invention, some of which are illustrated in FIG. 4. The advantage of the non-circular cross section is that clearance between the lateral peripheries of the piston and the inner side walls of the conduit is enhanced. This enhanced clearance not only allows the piston 27 to traverse over debris which accumulates within the conduit, but also allows an increased flow of water to pass between the piston and the interior sidewalls of the conduit, the larger water flow aiding in moving the debris down the conduit toward the pool pump and filter. It should be understood that the exact non-circular piston configuration, the degree of side clearance between the piston and the conduit, and the rate of water flow therebetween generated by the pump must be properly balanced in order to maintain the piston's responsiveness to the water pump in traversing the conduit drawn by the suction generated by the water flow. Factors which are known to affect such balance include the power of the water pump, the inner diameter of the storage conduit, the total clearance between the non-circular piston and the inner sidewalls of the conduit, and the general size of the particulate debris.

Alternatively, the skilled will know that the enhanced clearance between the piston and the inner sidewalls of the conduit may also be provided by employing a combination of a piston circular in cross section positioned within a conduit 29 having a non-circular interior cross section, as shown in FIG. 4. For example, the interior sidewall of the conduit could be grooved with one or more grooves along its lenghtwise extent. These grooves would catch particulate debris, and the water flow through the grooves would urge the debris toward the water pump and filter. Other piston and non-circular conduit combinations will come to the mind of the skilled to reduce the effect of particulate debris on movement of the piston within the conduit.

Additional aspects of preferred embodiments of the present apparatus include the flexible hose 18 comprising a floating hose, so as to help prevent tangling of the hose with the pool vacuum cleaner as it moves along submerged surfaces of the pool. Also, the communication between the conduit and the water pump preferably comprises a conduit in fluid communication with a pressure side of the water pump and a conduit in fluid communication with a suction side of the water pump. As shown in FIG. 1, each of these conduits or fluid communication is best disposed with a control valve 24 so as to enable the user to properly direct the water circulated by the pump.

The apparatus preferably also comprises a programmable controller 32 operably connected thereto. Such a controller could be a simple electrical timing device for example. A programmable controller 32, however, could be connected to control the water pump 12, and a plurality of valves 24, each valve of the plurality connected to control at least one fluid communication therein. In this fashion, the apparatus could be set up to automatically run at desired time intervals and with minimal human intervention required from the pool owner.

The apparatus retaining member 28 preferably comprises a hydraulically operated retaining member, which could be responsive to the water pump. More preferably, the retaining member 28 comprises an electrically operated retaining member, and most preferably the retaining member is electrically responsive to a programmable controller 32 operably connected to the apparatus.

The invention also includes a self-cleaning swimming pool 14 which includes features common to typical pools, and illustrated in FIG. 1. For example, water lines 15 and water jets 17, a main drain 19, a skimmer 21, various water line control valves 23 controlling the flow through the water lines, a water pump 12 and a filter 25. The self-cleaning swimming pool 14, however, includes additional features, comprising a water reservoir 34, a water pump 12, a pool vacuum cleaner 16, a flexible hose 18, a housing 20 for the pool vacuum cleaner, at least one conduit 22, a piston 26 positioned in the conduit, and a retaining member 28 engageable with the piston. A self-cleaning swimming pool 14 is illustrated in the schematic diagram shown in FIG. 1. The water reservoir 34, of course, is a typical swimming pool basin, whether it be an in-ground or above-ground pool. The water pump 12 is in fluid communication with the water reservoir 34 to circulate water therein, as in most typical pools. A pool vacuum cleaner 16 is positioned in the water reservoir 34 is preferably self-propelled for cleaning submerged surfaces of the water reservoir. The skilled understand that the pool vacuum cleaner 16 is self-propelled responsive to water circulation caused by the water pump.

As noted above for the apparatus, the self-cleaning swimming pool 14 includes a flexible hose 18 fluidly connecting the water pump 12 with the pool vacuum cleaner 16 to circulate water therethrough responsive to the water pump. A housing 20 positioned along a submerged surface of the water reservoir, the housing having sufficient capacity for therein receiving the pool vacuum cleaner 16 for storage upon retraction responsive to the water pump. A preferred location for positioning this housing 20 is built into an upper portion of a side wall of the pool, for example, just below the normal waterline for the pool. At least one conduit 22 is connected in fluid communication with the housing 20 and with the water pump 12, the conduit serving for therein receiving the flexible hose 18 upon retraction responsive to the water pump.

The fluid communication between the conduit 22 and connected between housing 20 and the water pump 12 is selectable between a pressure side and a suction side of the water pump. A piston is connected to the flexible hose adjacent an end opposite the cleaner and is movably positioned within the at least one conduit responsive to water circulation generated therethrough by the water pump. A retaining member is positioned to engage the piston adjacent the housing for retaining the hose deployed from the at least one conduit responsive to water circulation generated by the water pump.

In the apparatus or in the self-cleaning swimming pool, the skilled should recognize that the invention may be installed as an integral part of the swimming pool, for example, an in-ground pool, or may be an add-on apparatus retrofitted to an existing swimming pool to thereby automate the cleaning process. As an add-on retrofit, the relevant component parts of the invention may be installed to have a built-in appearance, or may be installed directly on submerged surfaces of the pool. It will be readily understood that, while possible, such surface mounting would be less desirable than a built-in fabrication, as surface mounted components are likely to at least partially obstruct the cleaning of the pool.

Figure 5:
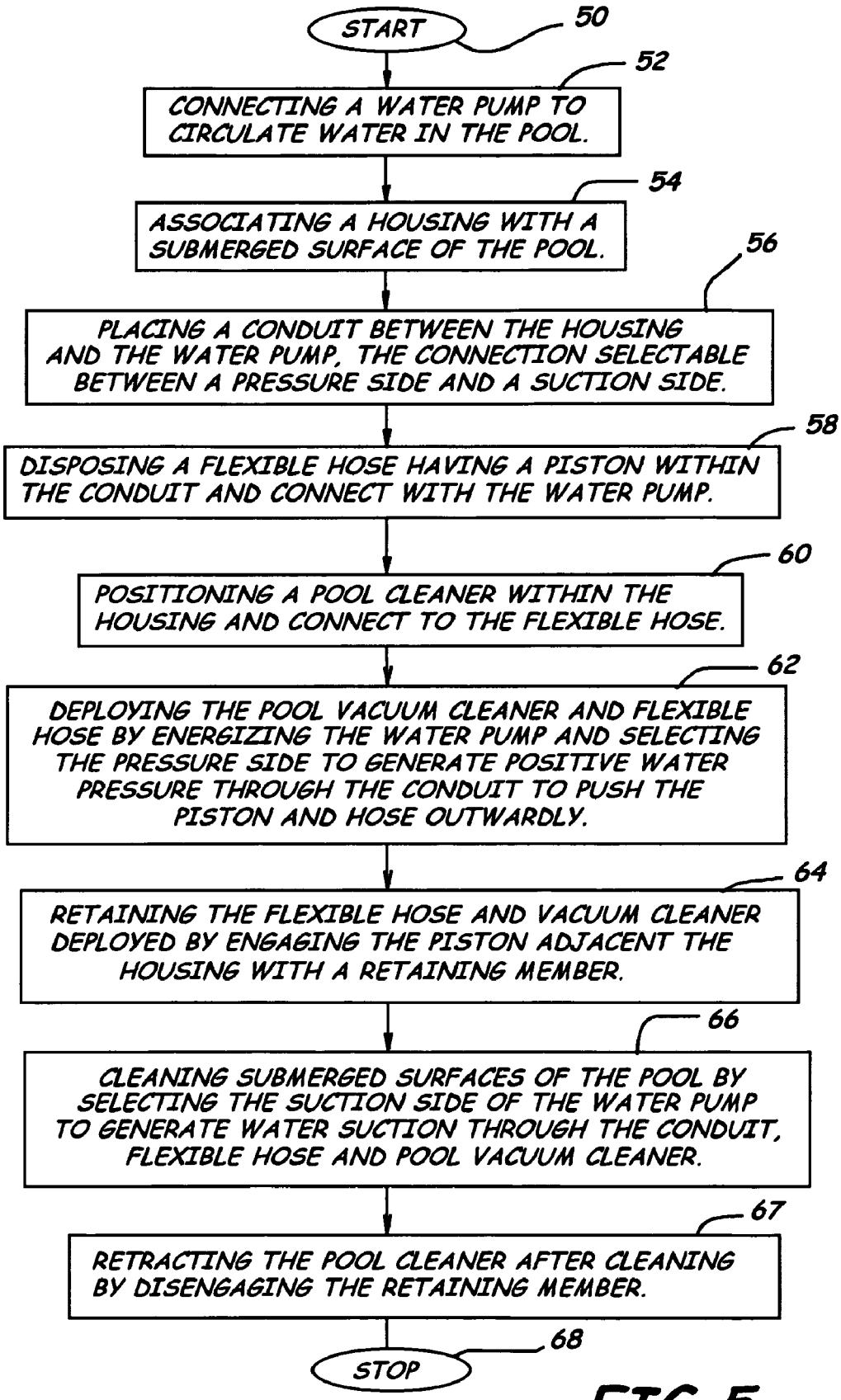
FIG. 5 is a flow diagram illustrating a preferred method of the invention.

An additional aspect of the invention includes a method of cleaning a filled swimming pool, which is illustrated in the flow diagram shown in FIG. 5. The method starts 50 by connecting a water pump 52 in fluid communication with the swimming pool to circulate water therein. A housing is positioned 54 along a submerged surface of the swimming pool, the housing having sufficient capacity for therein receiving a pool vacuum cleaner for storage when not in use. The method continues by connecting a conduit 56 in fluid communication between the housing and the water pump, the fluid communication being selectable between a pressure side and a suction side of the water pump. A further aspect of the method includes disposing a flexible hose 58 having a piston within the conduit and fluidly connected to the water pump, the piston being adjacent a hose first end, positioned within the conduit adjacent a conduit end opposite from the housing, and being movably responsive to water circulation generated by the water pump. Still, the method is continued by positioning a pool vacuum cleaner 60 within the submerged housing and fluidly connecting it with the flexible hose at an end spaced apart from the piston. As previously noted, the pool vacuum is preferably self-propelled for cleaning submerged surfaces of the swimming pool responsive to the water pump.

Deploying 62 the pool vacuum cleaner and the flexible hose is accomplished by energizing the water pump and selecting the pressure side to generate positive water pressure through the conduit to push the piston and hose outwardly from the conduit and, in turn, the vacuum cleaner from the housing. The method then includes retaining 64 the flexible hose and vacuum cleaner in deployment by engaging the piston adjacent the housing by a retaining member to prevent the hose and vacuum cleaner combination from being retracted into the housing and conduit by later suction generated by the water pump. Finally, the method comprises cleaning 66 submerged surfaces of the pool by selecting the suction side of the water pump to generate water suction through the conduit, connected flexible hose, and pool vacuum cleaner, thereby activating the vacuum cleaner to clean the pool. Thereafter, the method ends 68. An additional method step, however, includes retracting the pool vacuum cleaner after cleaning by disengaging the retaining member from the piston so as to retract the flexible hose into the conduit and the pool vacuum cleaner into the housing responsive to water suction generated by the water pump.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. An apparatus for cleaning a swimming pool, said apparatus comprising:

a water pump connected in fluid communication with the swimming pool, the connection being selectable from a pressure side of said pump to thereby generate water flow having positive pressure from the pump toward the pool or selectable from a suction side of said pump to thereby generate suction water flow toward the pump from the pool;

a pool cleaner in fluid communication with said water pump and adapted for cleaning submerged surfaces of the swimming pool responsive to suction water flow generated upon selection of the suction side of said pump;

a flexible hose fluidly connecting said water pump with said pool cleaner;

a housing associated with a submerged surface of the swimming pool, said housing having sufficient capacity for therein receiving said pool cleaner;

at least one conduit connecting said housing and said water pump for therethrough conducting the water flow generated by said water pump;

a piston connected to an end of said flexible hose opposite from said cleaner and positioned within said at least one conduit so that said piston is movably responsive to the water flow generated by said water pump through said conduit, whereby said piston is urged toward said housing by a positive pressure water flow and toward said pump by a suction water flow; and a retaining member positioned to releasably retain said piston adjacent said housing so as to prevent movement of said piston toward said pump responsive to suction water flow.

2. The apparatus of claim 1, wherein said piston has a non-circular cross section to thereby provide the predetermined clearance.

3. The apparatus of claim 1, wherein said at least one conduit has a non-circular cross section to thereby provide the predetermined clearance.

4. The apparatus of claim 1, wherein said flexible hose comprises a floating hose.

5. The apparatus of claim 1, wherein said at least one conduit further comprises a conduit in fluid communication with a pressure side of said water pump and a conduit in fluid communication with a suction side of said water pump.

6. The apparatus of claim 1, further comprising at least one valve operably controlling at least one fluid communication therein.

7. The apparatus of claim 1, further comprising a programmable controller operably connected thereto.

8. The apparatus of claim 7, wherein said programmable controller comprises an electrical timer.

9. The apparatus of claim 1, further comprising a programmable controller connected to control said water pump, and a plurality of valves, each valve of the plurality connected to control at least one fluid communication therein.

10. A swimming pool comprising:

a water reservoir;

a water pump connected in fluid communication with said water reservoir, the connection being selectable from a pressure side of said pump to thereby generate water flow having positive pressure from the pump toward the water reservoir or selectable from a suction side of said pump to thereby generate water flow having suction toward the pump from the water reservoir;

a cleaner positioned in fluid communication with said water pump and adapted for cleaning submerged surfaces of said water reservoir responsive to water flow generated upon selection of the suction side of said pump;

a flexible hose fluidly connecting said water pump with said cleaner;

a housing associated with a submerged surface of said water reservoir, said housing having sufficient capacity for therein receiving said cleaner;

at least one conduit connecting said housing with said water pump for therethrough conducting the water flow generated by said water pump;

a piston connected to an end of said flexible hose opposite from said cleaner and positioned within said at least one conduit so that the piston is movably responsive to the water circulation generated by said water pump through said conduit, whereby said piston is urged toward said housing by a positive pressure water flow and is urged toward said pump by a suction water flow; and a retaining member positioned to releasably retain said piston adjacent said housing so as to prevent movement of said piston toward said pump responsive to suction water flow.

11. The apparatus of claim 10 wherein said piston has a non-circular cross section to thereby provide the predetermined clearance.

12. The apparatus of claim 10 wherein said at least one conduit has a non-circular cross section to thereby provide the predetermined clearance.

13. The swimming pool of claim 10 wherein said flexible hose comprises a floating hose.

14. The swimming pool of claim 10, wherein said at least one conduit further comprises a conduit in fluid communication with a pressure side of said water pump and a conduit in fluid communication with a suction side of said water pump.

15. The swimming pool of claim 10 further comprising at least one valve operably controlling at least one fluid communication therein.

16. The swimming pool of claim 10 further comprising a programmable controller operably connected thereto.

17. The swimming pool of claim 16, wherein said programmable controller comprises an electrical timer.

18. The swimming pool of claim 10 further comprising a programmable controller connected to control said water pump and a plurality of valves, each valve of the plurality connected to control at least one fluid communication therein.

19. A method of cleaning a filled swimming pool, the method comprising:

connecting a water pump in fluid communication with said swimming pool to generate water flow, the connection being selectable from a pressure side of said pump to thereby generate water flow having positive pressure from the pump through the conduit toward the pool or selectable from a suction side of said pump to thereby generate suction water flow toward the pump through the conduit from the pool;

associating a housing with a submerged surface of the swimming pool, the housing having sufficient capacity for therein receiving a pool cleaner;

placing a conduit connecting the housing and the water pump to conduct the water flow therethrough;

disposing a piston within the conduit, the piston being connected to a first end of a flexible hose, and being movably responsive within the conduit to water flow generated by the water pump;

positioning a pool cleaner within the housing and fluidly connected with the flexible hose at an end opposite from the piston, the pool cleaner adapted for cleaning submerged surfaces of the swimming pool responsive to suction water flow;

deploying the pool cleaner and flexible hose by energizing the water pump and selecting the pressure side thereby generating water flow having sufficient positive water pressure through the conduit to push the piston toward the housing;

retaining the piston adjacent the housing with a retaining member so as to prevent movement of the piston toward the pump responsive to suction water flow; and cleaning submerged surfaces of the pool after retaining by selecting the suction side of the water pump to thereby generate suction water flow from the pool toward the pump through the cleaner, flexible hose, piston and conduit.

20. The method of claim 10, further comprising retracting the pool cleaner after cleaning by disengaging the retaining member from the piston so as to cause the piston to be moved away from the housing into the conduit to thereby retract the flexible hose into the conduit and the pool cleaner into the housing responsive to water suction generated by the water pump.

21. The method of claim 19 wherein said piston has a non-circular cross section to thereby provide the predetermined clearance.

22. The method of claim 19 wherein said at least one conduit has a non-circular cross section to thereby provide the predetermined clearance.

23. The method of claim 19 wherein the flexible hose comprises a floating hose.

24. The method of claim 19, wherein the at least one conduit further comprises a conduit in fluid communication with a pressure side of the water pump and a conduit in fluid communication with a suction side of the water pump.

25. The method of claim 19, further comprising at least one valve operably controlling at least one fluid communication therein.

26. The method of claim 19 further comprising a programmable controller operably connected thereto.

27. The method of claim 26, wherein the programmable controller comprises an electrical timer.

28. The method of claim 19 further comprising a programmable controller connected to control the water pump and a plurality of valves, each valve of the plurality connected to control at least one fluid communication therein.

* * * * *